US011458522B2

(12) United States Patent
Stahl

(10) Patent No.: US 11,458,522 B2
(45) Date of Patent: Oct. 4, 2022

(54) EXPANDING AND FORMATTING PROFILED METAL STRIP

(71) Applicant: HACANOKA GMBH, Vöhringen (DE)

(72) Inventor: Karl-Hermann Stahl, Voehringen (DE)

(73) Assignee: HACANOKA GMBH, Voehringen (DE)

( * ) Notice: Subject to any disclaimer, the term of this patent is extended or adjusted under 35 U.S.C. 154(b) by 240 days.

(21) Appl. No.: 16/634,723

(22) PCT Filed: Aug. 18, 2018

(86) PCT No.: PCT/DE2018/000245

§ 371 (c)(1),
(2) Date: Jan. 28, 2020

(87) PCT Pub. No.: WO2019/068274

PCT Pub. Date: Apr. 11, 2019

(65) Prior Publication Data

US 2020/0230684 A1 Jul. 23, 2020

(30) Foreign Application Priority Data

Oct. 7, 2017 (DE) ..... 10 2017 009 311.3

(51) Int. Cl.
*B21D 31/04* (2006.01)

(52) U.S. Cl.
CPC ..... *B21D 31/043* (2013.01)

(58) Field of Classification Search
CPC .... B21D 31/04; B21D 31/043; B21D 31/046; Y10T 29/18
See application file for complete search history.

(56) References Cited

U.S. PATENT DOCUMENTS 1,195,221 A * 8/1916 Herr ..... B21D 31/046 29/6.1
3,760,470 A * 9/1973 Felsenthal ..... B21D 31/046 29/6.1

(Continued)

*Primary Examiner* — Debra M Sullivan
(74) *Attorney, Agent, or Firm* — Andrew Wilford

(57) ABSTRACT

The method serves for expanding and formatting profiled metal strip material (1) to form a netting-like mat structure (2) of a predeterminable mesh width by a continuous drawing-open process. For this purpose, the strip material (1) is provided with notches (3), which extend in the longitudinal direction of the strip, are of a limited length and between them form metal strands (11), wherein, after the expanding and formatting, the unnotched regions form netting nodes (4) and initially the metal strands (11) are connected to one another by way of adjoining webs in the base of the notch. The webs have fatigue-fracture induced incipient tears formed by flexural deformation. The remaining web is then severed by a separating roll, so that the metal strands (11) are reliably separated from one another in the notch region and the strip material (1) can be drawn open to form the netting-like structure. The strip material (1) is first drawn open at the beginning of the strip to the intended mesh width in such a way that some rows of mesh are aligned orthogonally and oriented at right angles to the edge of the strip with respect to their mesh diagonal. The prepared beginning of the strip is placed with the meshes onto the spikes (5) of a spiked roll (5.1) of a pair of rolls (5), after which the pressure roll (5.2) of the pair of rolls (5) is infed towards the spiked roll (5.1) and with it forms a rolling gap. In this case, the arrangement of the spikes (6) is chosen such that every second mesh—in both orthogonal directions—is shaped by a spike (6), in that the spikes (6) of the spiked roll (5.1) enter the clearances (7) in the pressure roll (5.2).

14 Claims, 5 Drawing Sheets

(56) References Cited

U.S. PATENT DOCUMENTS

| | | | | |
|---|---|---|---|---|
| 3,853,626 | A | 12/1974 | Daniels, Jr. | |
| 5,461,761 | A * | 10/1995 | Knopfli ..... | B21D 31/046 29/6.1 |
| 9,180,602 | B2 | 11/2015 | Stahl | |

* cited by examiner

EXPANDING AND FORMATTING PROFILED METAL STRIP

CROSS REFERENCE TO RELATED APPLICATIONS

This application is the US-national stage of PCT application PCT/DE2018/000245 filed 18 Aug. 2018 and claiming the priority of German patent application 102017009311.3 itself filed 7 Oct. 2017.

FIELD OF THE INVENTION

The invention relates to a method of expanding and formatting profiled metal strip to form expanded metal of a predetermined mesh-hole width by a continuous spreading process, to which end the strip is provided with slits that extend longitudinally of the strip, are of limited length, and form metal strands between them, the slit-free regions forming mesh nodes after the expanding and formatting, and the metal strands being initially connected to one another at the ends of the slits, the connections also having fatigue fracture-induced incipient cracks formed by flexural deformation and the remaining part being severed by a separating roll, so that the metal strands are reliably separated from one another at the slits and the strip can be spread to form the expanded metal. The invention further relates to an apparatus for carrying out the method.

BACKGROUND OF THE INVENTION

The basic workflow of such a method has already been described in EP 2 613 898 [U.S. Pat. No. 9,180,602], which in principle makes it possible to transform a strip processed according to the principles of the known prior art into expanded metal. Further details on the pretreatment of the strip can be found in the above-cited EP 2 613 898.

It has been found in practice that it is quite difficult to spread the strip in the manner described in the prior art in order to make good, uniform expanded metal. Therefore, in order to further improve the dimensional accuracy of the desired expanded metal as part of a continuous manufacturing process, further measures are required that also ensure, in particular, that this expanded metal is formed in a more uniform and rational manner.

OBJECT OF THE INVENTION

It is therefore the object of the invention to provide a method of the type described above that achieves uniform shaping and thus uniform mesh formation over the entire width and length of the resultant expanded metal by a continuous spreading process.

SUMMARY OF THE INVENTION

This object is achieved in terms of the method according to the invention in that, in order to prepare it for spreading, the strip is first spread to the intended mesh-hole width at the leading end of the strip, for example manually with mechanical support, that some rows of mesh are aligned so as to be inherently orthogonal and oriented at right angles to the edge of the strip relative to their mesh diagonal, that the prepared leading end of the strip is further conveyed to an upstream rotationally driven pair of rollers of a spreader by placement of the leading end of the strip onto the preferably lower roller, which is a spiked roller, such that the spikes of the spiked roller enter the mesh holes, whereupon the preferably upper roller, which is provided with lands and recesses and embodied as a pressure roller, is advanced toward the lower one, so that the two rollers form a roll gap between them, the arrangement of the spikes being selected such that, in both orthogonal directions, every other mesh hole is shaped by a spike as the spikes of the spiked roller enter the recesses of the pressure roller.

The advantage achieved by the invention essentially consists in the fact that the spreading forces are applied in every other mesh hole substantially only in the roll gap in the area of the largest mesh-hole width in consideration of the resilience, thus enabling the downstream part of the workpiece being spread to form freely. Uniform mesh holes are thus formed, with the spreading forces acting relatively evenly over the entire width of the expanded metal. In a preferred embodiment of the invention, the edge mesh holes as seen longitudinally of the strip are pulled open by a spike that is moved axially of the roller by a control cam at the edge of the spiked roller. This imparts largely linearly extending edges to the expanded metal.

It has been found to be advantageous in the context of the invention if the spread, initially roughly shaped expanded metal is fed to an additional pair of rollers for post-forming, the surface structure of this pair of rollers corresponding substantially to the upstream pair of rollers, but with twice the number of spikes and a correspondingly modified design of the top roller to compensate for resilient forces of the expanded metal and to achieve good dimensional accuracy. In addition, this ensures in particular that bulges, which can be disruptive during subsequent winding, are smoothed by light roll forming.

It is advantageous if the upstream and the downstream pair of rollers are aligned with one another in such a way that each of the spikes of the downstream rollers enter all of the mesh holes.

It has been found to be advantageous for the formation of the mesh holes if the spikes of the upstream and downstream pair of rollers have the shape of a pyramid or of a truncated pyramid and are designed to be symmetrical or asymmetrical depending on the position. Another, very advantageous embodiment of the invention is that the downstream pair of rollers is followed by a third pair of rollers, the lower roller being provided with guide grooves for the metal strands, and the mesh nodes connecting the metal strands are positioned precisely on this roller and pressed in the guide groove by disks that are provided on the upper roller and arranged in the axial direction with mutual spacing, with pushers also being arranged between the disks that are aligned centrally relative to the mesh nodes and press them against cutting blades of the lower roller, and the dwindling separation cracks left over from the rolling and separating of the metal strands and ending at the mesh nodes are cut out.

It is especially favorable and therefore preferred in the context of the invention if the cutting device is embodied such that the region adjacent the mesh nodes and formed by the metal strands meeting there, i.e. the dwindling separation crack between the strands, is provided with a small radius and the tool is embodied such that, after the cutting process, the surface is smoothed with a build-up of compressive stress.

An apparatus that achieves the object according to the invention is characterized by a spreader with an upstream rotationally driven pair of rollers in which the preferably lower roller is a spiked roller and the preferably upper roller is provided with lands and recesses as a pressure roller that can be moved toward the lower one, so that both rollers form a roll gap between them for profiled metal strip of expanded metal, the arrangement of the spikes being selected such that, in both orthogonal directions, every other mesh hole of the expanded metal is formed by a spike as the spikes of the spiked roller enter the recesses of the pressure roller.

The spreading process is substantially facilitated and improved if the spiked roller has an axially displaceable spike on the edge that is moved via a control cam at the edge of the spiked roller and, as seen longitudinally of the strip, draws open every other edge mesh hole.

Furthermore, it has proven advantageous if the spreader has an additional pair of rollers for post-forming the strip, the surface structure of this pair of rollers corresponding substantially to the upstream pair of rollers, but with twice the number of spikes and a correspondingly modified design of the top roller in order to compensate for resilient forces present in the shaped expanded metal of the strip and achieve good dimensional accuracy.

It is recommended in the context of the invention that the upstream and the downstream pairs of rollers be aligned with one another in such a way that the spikes of the downstream spiked roller enter all of the mesh holes of the expanded metal.

More specifically, the spikes of the upstream and downstream pair of rollers can, in a preferred embodiment, have the shape of a pyramid or of a truncated pyramid and are designed to be symmetrical or asymmetrical depending on the position. Finally, it has proven expedient in the context of the invention that the downstream pair of rollers is followed by a third pair of rollers, the lower roller being provided with guide grooves for positioning the mesh nodes connecting the metal strands, and disks that are on the upper roller with mutual spacing are provided that press the mesh nodes are pressed in the axial direction into the guide grooves, with pushers being arranged between the disks that are aligned centrally relative to the mesh nodes and press them into cutting blades of the upstream roller, and the dwindling separation cracks left over from the rolling and separating of the metal strands and ending at the mesh nodes are cut out.

It has proven expedient in this regard if the cutting device has a round design so that the region adjacent the mesh nodes and formed by the metal strands meeting there is provided with a small radius, the tool being embodied such that a smoothing of the surface is achieved after the cutting process with simultaneous build-up of compressive stress.

BRIEF DESCRIPTION OF THE DRAWING

In the following, the invention will be explained in greater detail on the basis of an embodiment illustrated in the spreading, in which.

SPECIFIC DESCRIPTION OF THE INVENTION

Figure 1:
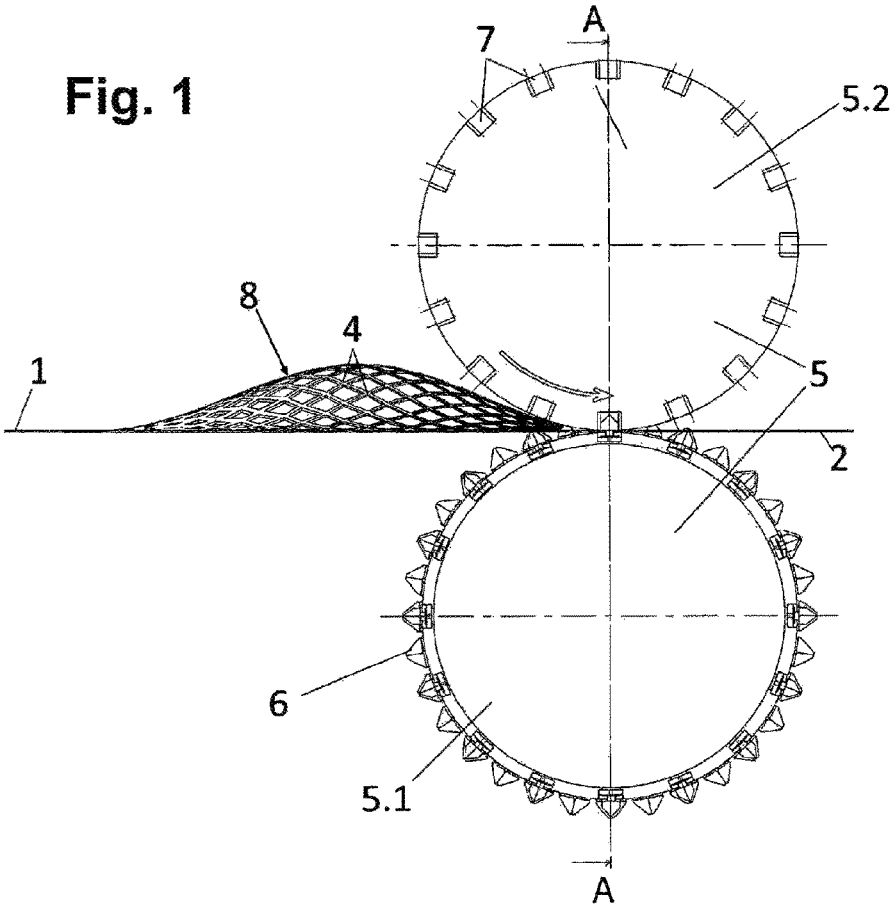
FIG. 1 is a side view of part of the apparatus.

The apparatus shown in the drawing serves for carrying out a method of expanding and formatting profiled metal strip 1 to form expanded metal 2 of a predetermined mesh-hole width by a continuous spreading process. For this purpose, the strip 1 is provided with slits 3 that extend longitudinally of the strip, are of limited length, and form metal strands 11 between them, as indicated and shown in FIG. 2 on the left. The slit-free regions then form mesh nodes 4 after the expanding and formatting, as can also be seen in the area to the right in FIG. 2.

The metal strands are initially connected to one another at the ends of the slits. However, these connections also have fatigue fracture-induced incipient cracks formed by flexural deformation, so that the remaining part is finally severed by a separating roll. As a result, the metal strands 11 are reliably separated from one another at the slits, so that the strip 1 can be drawn into expanded metal.

It is important in the method according to the invention to make expanded metal of defined high quality in the context of a continuous manufacturing process in which uniform shaping and hence uniform mesh formation takes place over the entire width and length of the subsequent expanded metal 2. For this purpose, the strip 1 is first spread to the intended mesh-hole width at the leading end of the strip, so that rows of mesh holes are aligned orthogonally and extend at right angles to the longitudinal edges of the strip with regard to their mesh diagonal. This is done manually with mechanical support.

The prepared leading end of the strip is then fed to a first, rotationally driven pair of rollers 5 of a spreader by placement of the leading end of the strip preferably onto the lower roller, which is a spiked roller 5.1 whose spikes 6 enter the mesh holes. The preferably upper roller, which is provided with lands and recesses and embodied as a pressure roller 5.2, is advanced toward the lower roller, so that the two rollers form a roll gap. The arrangement of the spikes 6 is selected such that, in both orthogonal directions, every other mesh hole is shaped by a spike 6 as the spikes 6 of the spiked roller 5.1 enter the recesses 7 of the pressure roller 5.2.

Figure 4:
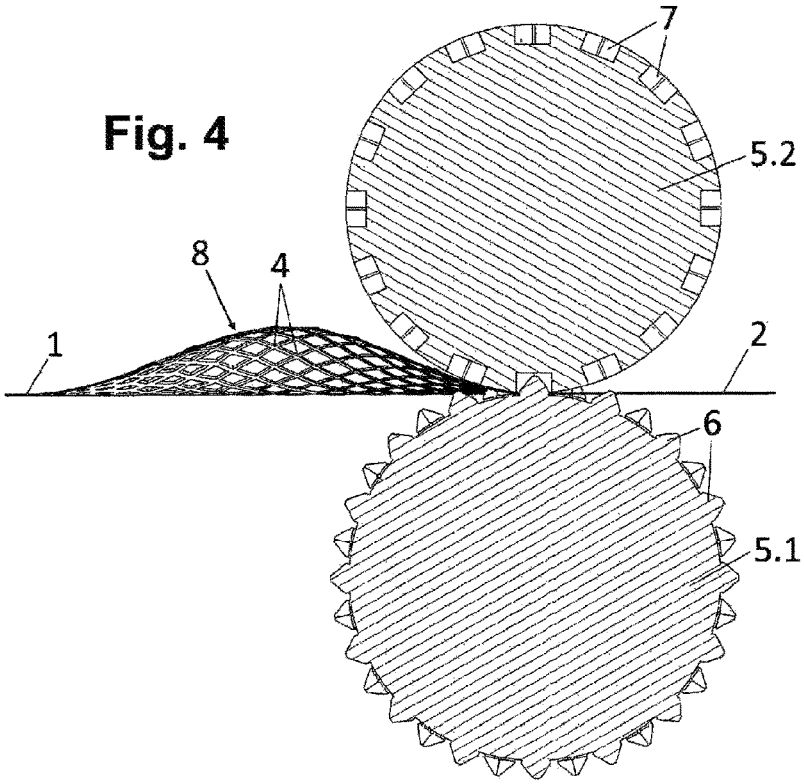
FIG. 4 is a section along line B-B of FIG. 2 through the apparatus.

It is thereby achieved that the spreading forces are applied in every other mesh hole substantially only in the roll gap in the area of the largest mesh-hole width in consideration of the resilience. This enables the upstream mesh region 8 to form freely in terms of its spatial shape, as can be seen in particular in FIGS. 1, 4 and 6 in the form of an upward bulge. Uniform mesh formation is thus achieved, with the spreading forces acting relatively evenly over the entire width of the expanded metal.

Figure 2:
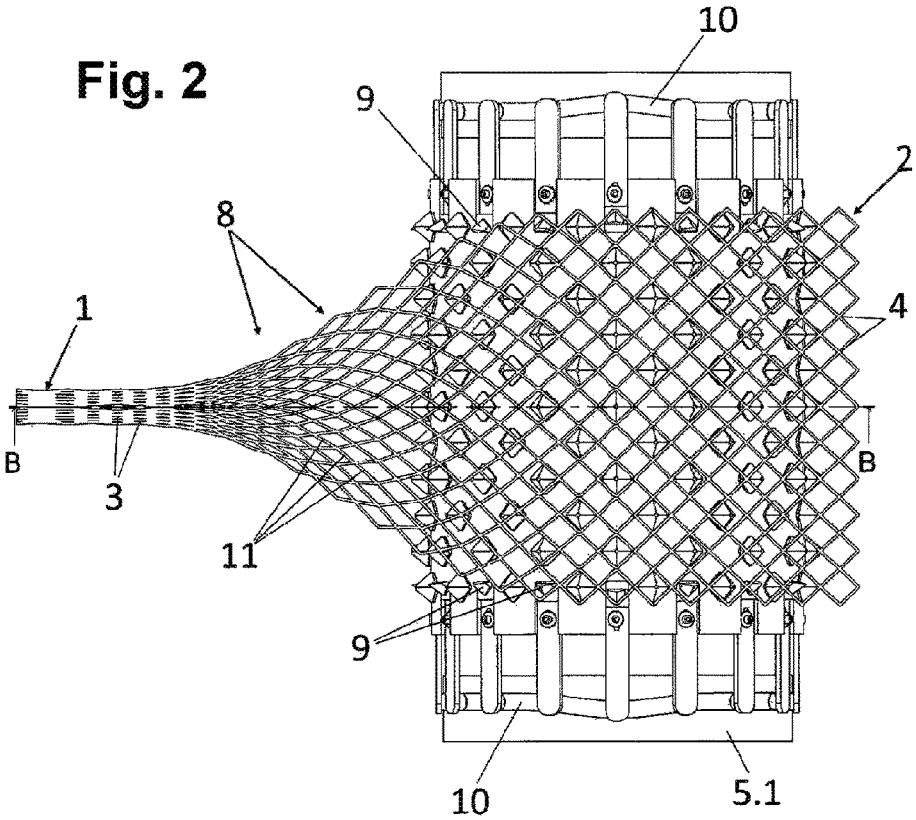
FIG. 2 is a top view of the lower roller of the apparatus of FIG. 1.
Figure 3:
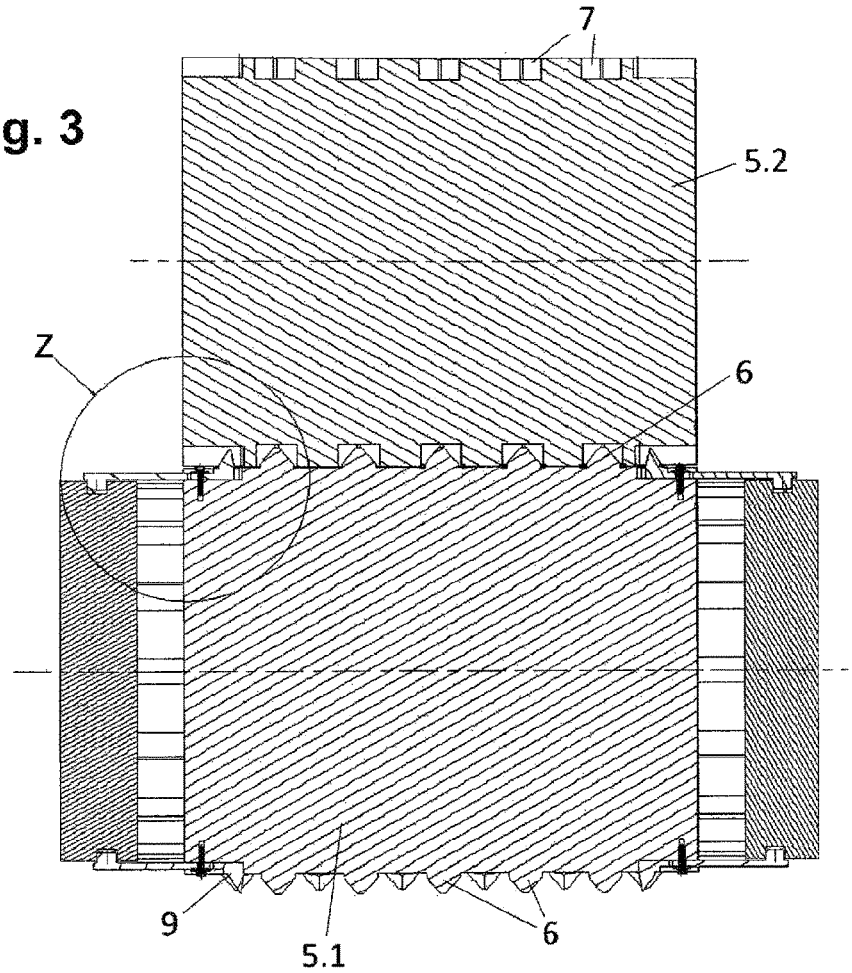
FIG. 3 is a section along line A-A of FIG. 1 through the apparatus.
Figure 5:
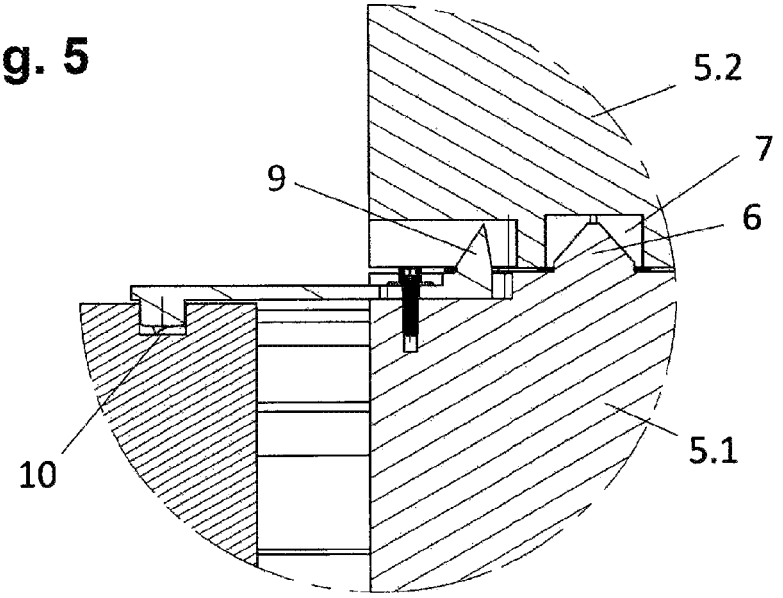
FIG. 5 shows detail Z of FIG. 3.
Figure 6:
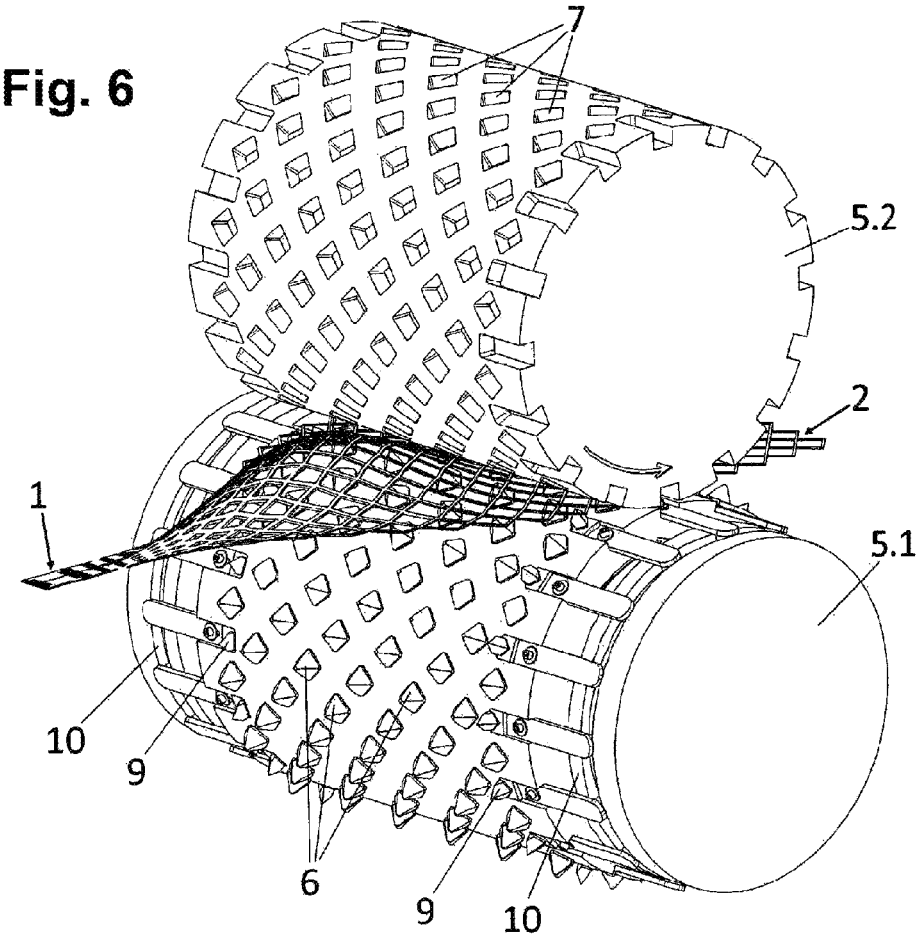
FIG. 6 is a perspective view of the apparatus of FIG. 1.
Figure 7:
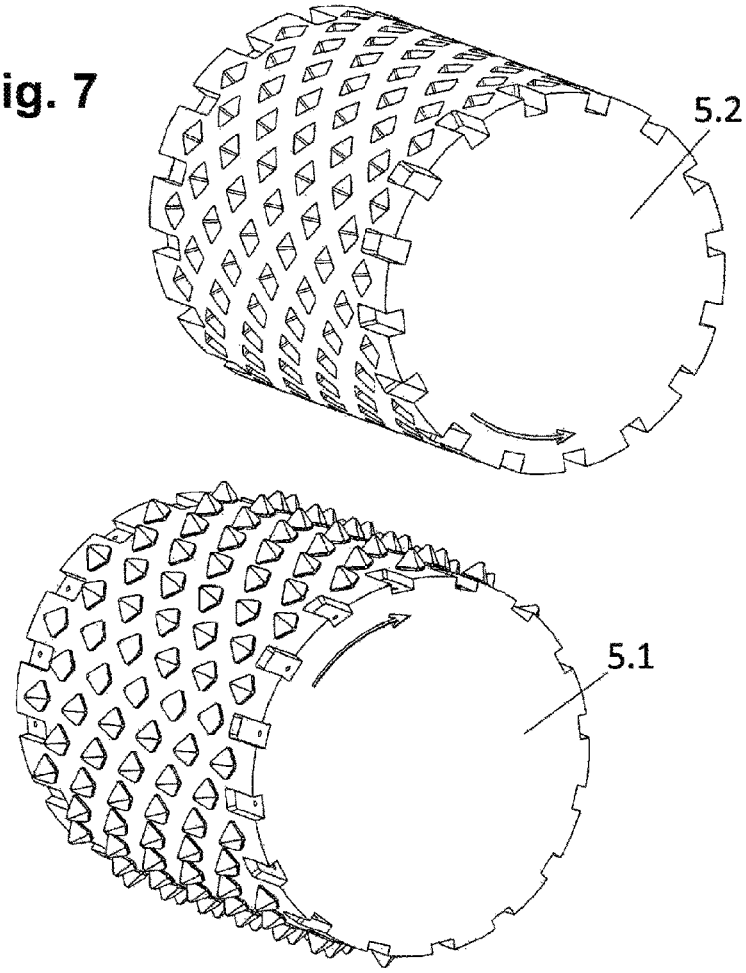
FIG. 7 is a perspective view like FIG. 6 of the apparatus of FIG. 1 but without the strip and axially displaceable spikes.

As can be seen particularly in FIGS. 2, 3, and 5 but also in FIG. 6, the alternate mesh holes at the longitudinal strip edges are pulled open by axially displaceable spikes 9 that are moved by control cams 10 at the ends of the spiked roller 5.1. This forms a straight edge on the expanded metal.

Although not shown in further detail in the drawing, it is contemplated as an advantageous embodiment of the invention that the spread, initially roughly shaped expanded metal 2 be fed to an additional pair of rollers for post-forming. The surface structure of this pair of rollers corresponds substantially to that of the first pair of rollers, but it can be provided with twice the number of spikes and a correspondingly modified design of the top roller in order to compensate for resilient forces of the expanded metal and achieve good dimensional accuracy. In addition, this ensures in particular that bulges, which can be disruptive during subsequent winding, are smoothed by light roll forming.

In a manner not shown in further detail in the spreading, it is advantageous if the first and the downstream pair of rollers are aligned with one another in such a way that each of the spikes 9 of the downstream roller enter all of the mesh holes.

In the upstream and downstream pair of rollers, the spikes 9 for the shaping of the mesh holes have the shape of a pyramid or of a truncated pyramid and are designed to be symmetrical or unsymmetrical depending on position.

Figure 8:
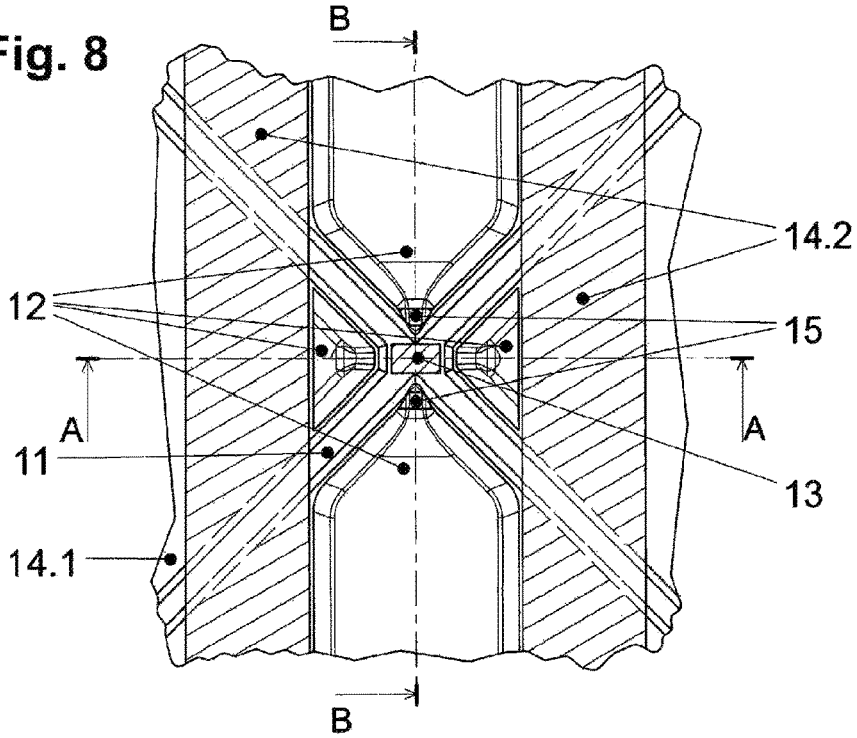
FIG. 8 is a top view of a detail of the lower roller.
Figure 9:
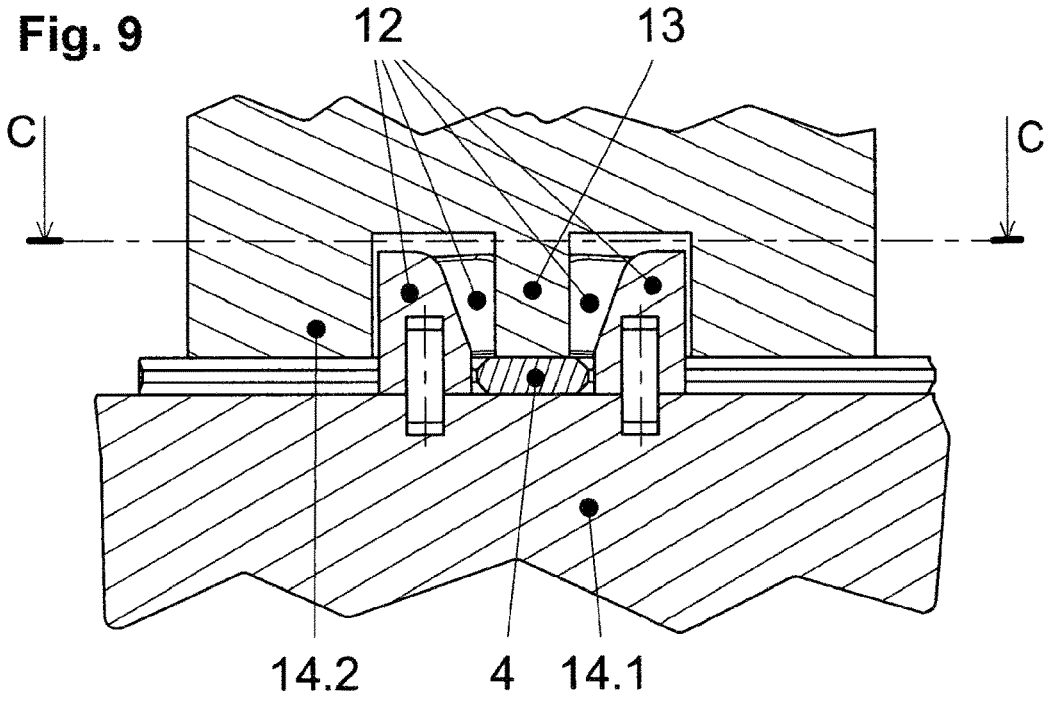
FIG. 9 is a section taken along line A-A of FIG. 8.
Figure 10:
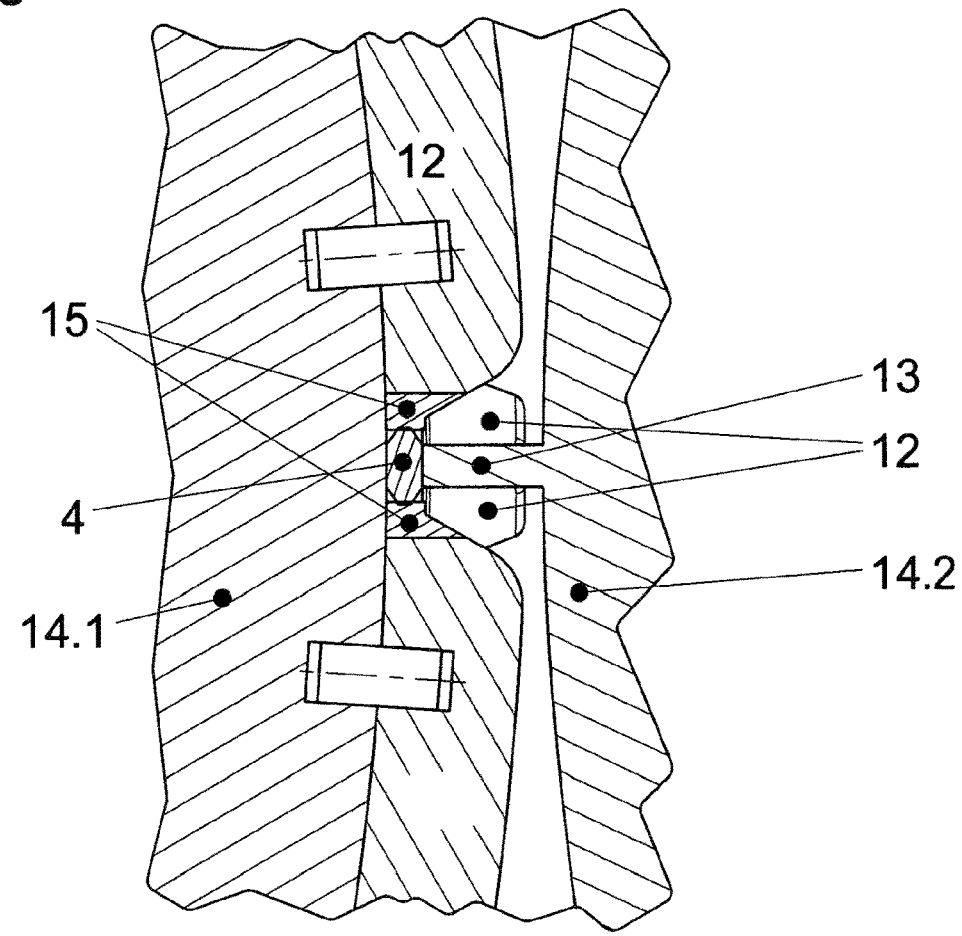
FIG. 10 is a section taken along line B-B of FIG. 8.

According to the invention the downstream pair of rollers is followed by a third pair of rollers. As shown in FIGS. 8 to 10, one roller 14.1 of this pair of rollers is provided with guide grooves for the metal strands such that the mesh nodes 4 connecting the metal strands 11 are positioned precisely on this roller. In addition, they are pressed into the guide grooves by disks 12 provided on the other roller 14.2 and arranged in the axial direction with mutual spacing. Furthermore, pushers 13 are arranged between the disks 12 that are aligned centrally relative to the mesh nodes 4 and press them into cutting blades 15 of the upstream roller 14.1. As a result, the dwindling separation cracks that end at the mesh nodes 4 and are left over from the rolling and separating of the metal strands 11 are cut out.

The cutting device is embodied in such a way that the region adjacent the mesh nodes 4 and formed by the metal strands meeting there, that is, the separation crack between the strands, is provided with a small radius. For this purpose, the tool is also embodied in such a way that, after the cutting process, a smoothing of the surface is also achieved with a build-up of compressive stress.

The invention claimed is:

1. A method of expanding and formatting profiled metal strip to form expanded metal of a predetermined mesh-hole width by a continuous spreading process, the method comprising the steps of:

forming the strip with slits that extend longitudinally of the strip, are of limited length, and form metal strands between them, whereby slit-free regions can form mesh nodes after expanding and formatting, the metal strands being initially connected to one another at ends of the slits at connections;

first spreading the strip transversely to the predetermined mesh-hole width at the leading end of the strip such that a plurality of rows of mesh holes are aligned orthogonal to lateral edges of the strip;

conveying the spread leading end of the strip to an upstream rotationally driven pair of upper and lower rollers of a spreader;

fitting the leading end of the strip onto spikes of the lower roller such that the spikes enter respective ones of the mesh holes;

moving the upper roller, which is provided with lands and recesses and embodied as a pressure roller, downward onto the lower roller so that the spikes of the lower roll fit into respective recesses of the upper roll and the upper and lower rollers form a roll gap holding the spread strip, the arrangement of the spikes being such that, in both orthogonal directions in a plane of the strip at the gap, every other mesh hole is shaped by a spike as the spikes of the spiked roller enter the recesses of the pressure roller; and counterrotating the rollers so as to draw in and laterally expand the strip while advancing the strip downstream.

2. The method according to claim 1, further comprising the step of:

pulling open edge mesh holes of the strip by spikes displaceable axially of the lower roller and movable axially of the lower roller via a control cam at the edge of the lower roller.

3. The method according to claim 1 further comprising the step of:

feeding the spread, initially roughly shaped expanded metal to a downstream pair of rollers for post-forming, the surface structure of the downstream pair of rollers corresponding substantially to the upstream pair of rollers, but with twice the number of spikes and a correspondingly modified design of the top roller to compensate for resilient forces of the expanded metal and to impart dimensional accuracy.

4. The method according to claim 3, wherein the upstream and the downstream pairs of rollers are aligned with one another in such a way that the spikes of the downstream roller enter all of the mesh holes as the strip passes through the downstream roller pair.

5. The method according to claim 3, wherein the spikes of the upstream and downstream pairs of rollers have the shape of a pyramid or of a truncated pyramid and are symmetrical or asymmetrical depending on position on a surface of the lower roller.

6. The method according to claim 3, further comprising the step of:

feeding the spread strip from the downstream pair of rollers to a third pair of rollers of which one roller is provided with guide grooves for the metal strands, the mesh nodes connecting the metal strands being positioned precisely on this one roller of the third pair and pressed in the guide groove by disks that are provided on the downstream roller and axially spaced; and pushing the nodes with pushers provided between the disks and aligned centrally relative to the mesh nodes and thereby pressing the nodes into cutting blades of the upstream roller so that separation cracks left over from the rolling and separating of the metal strands and ending at the mesh nodes are cut out.

7. The method according to claim 6, wherein the disks and pushers are embodied such that the region adjacent the mesh nodes and formed by the metal strands meeting there is provided with a small radius, and the disks and pushers smooth the strip surface after the cutting process with a build-up of compressive stress.

8. An apparatus for making expanded metal from longitudinally extending metal strip formed with longitudinally extending and transversely spaced rows of staggered slits, the apparatus comprising:

a spreader with an upstream rotationally driven pair of upper and lower rollers in which the lower roller is a spiked roller and the upper roller is provided with lands and recesses as a pressure roller and can be advanced toward the lower roller so that upper and lower rollers form a roll gap for profiled metal strip of expanded metal, the arrangement of the spikes being selected such that, longitudinally and transversely of the strip, every other mesh hole of the expanded metal is formed by a spike as the spikes of the lower roller enter the recesses of the upper roller.

9. The apparatus according to claim 8, wherein the lower roller has an axially displaceable spike on each axial end that is moved via a control cam at the edge of the lower roller and, as seen longitudinally of the strip, draws open every other mesh hole to impart a straight lateral edge to the strip.

10. The apparatus according to claim 8, further comprising:

an additional pair of upper and lower downstream rollers in the spreader for post-forming the strip, the surface structures of the downstream rollers corresponding substantially to the upstream pair of rollers, but with twice the number of spikes and a correspondingly modified design of the top roller in order to compensate for resilient forces present in the shaped expanded metal of the strip and impart dimensional accuracy.

11. The apparatus according to claim 10, wherein the upstream and the downstream pairs of rollers are aligned with one another in such a way that the spikes of the lower downstream roller enter all of the mesh holes of the expanded metal as the strip passes through the downstream pair of rollers.

12. The apparatus according to claim 10, wherein the spikes of the upstream and downstream pair of rollers have the shape of a pyramid or of a truncated pyramid and are symmetrical or asymmetrical depending on position on a surface of the lower roller.

13. The apparatus according to claim 10, further comprising, downstream of the downstream pair of rollers, A third pair of rollers of which the lower roller forms guide grooves for positioning the mesh nodes connecting the metal strands and disks on the upper roller of the third pair are mutually spaced for pressing the mesh nodes axially into the guide grooves, with pushers on the lower roller of the third pair between the disks that are aligned centrally relative to the mesh nodes and press them into cutting blades of the lower roller of the third pair such that the dwindling separation cracks left over from the rolling and separating of the metal strands and ending at the mesh nodes are cut out.

14. The method according to claim 13, wherein the cutting device is round so that regions adjacent the mesh nodes and formed by the metal strands meeting there are formed with a small radius, and the tool is embodied such that a smoothing of the surface is achieved after the cutting process with simultaneous build-up of compressive stress.

* * * * *